US012104316B2

(12) United States Patent
Liang et al.

(10) Patent No.: US 12,104,316 B2
(45) Date of Patent: Oct. 1, 2024

(54) MANUFACTURING METHOD FOR ANTIBACTERIAL FIBER

(71) Applicant: FORMOSA PLASTICS CORPORATION, Kaohsiung (TW)

(72) Inventors: Chih-Hsiang Liang, Kaohsiung (TW); Yu-Cheng Hsu, Kaohsiung (TW); Tang-Chun Kao, Kaohsiung (TW); Chien-Hsu Chou, Kaohsiung (TW); Yi-Chuan Chang, Kaohsiung (TW); Chih-Hsuan Ou, Kaohsiung (TW); Han-Chang Wu, Kaohsiung (TW); Long-Tyan Hwang, Kaohsiung (TW)

(73) Assignee: FORMOSA PLASTICS CORPORATION, Kaohsiung (TW)

( * ) Notice: Subject to any disclaimer, the term of this patent is extended or adjusted under 35 U.S.C. 154(b) by 337 days.

(21) Appl. No.: 17/853,054

(22) Filed: Jun. 29, 2022

(65) Prior Publication Data

US 2022/0411992 A1 Dec. 29, 2022

(30) Foreign Application Priority Data

Jun. 29, 2021 (TW) ..... 110123905

(51) Int. Cl.
*D06M 10/06* (2006.01)
*D06M 10/02* (2006.01)
(Continued)

(52) U.S. Cl.
CPC ..... *D06M 11/42* (2013.01); *D06M 10/02* (2013.01); *D06M 10/06* (2013.01); *D06M 11/44* (2013.01); *D06M 11/46* (2013.01); *D06M 11/49* (2013.01)

(58) Field of Classification Search
CPC ..... D06M 11/42; D06M 10/06; D06M 11/44; D06M 11/36; D06M 11/49
See application file for complete search history.

(56) References Cited

U.S. PATENT DOCUMENTS 5,071,644 A * 12/1991 Viegas ..... A61K 47/10 523/122
6,190,407 B1 2/2001 Ogle et al.
(Continued)

FOREIGN PATENT DOCUMENTS

CN 1376822 A 10/2002
CN 1566513 A 1/2005
(Continued)

OTHER PUBLICATIONS

MacKeen, Particia, et al., "Silver-Coated Nylon Fiber as an Antibacterial Agent". Antimicrobial Agents and Chemotherapy, Jan. 1987, p. 93-99.*
(Continued)

*Primary Examiner* — Bret P Chen
(74) *Attorney, Agent, or Firm* — MUNCY, GEISSLER, OLDS & LOWE, P.C.

(57) ABSTRACT

A manufacturing method for an antibacterial fiber includes the following steps. A dipping step is performed to soak a conductive fiber in a solution, in which the solution includes an ionic compound, and the ionic compound includes a metal cation. An oxidation step is performed by using the conductive fiber as an anode, such that an antibacterial material produced by the solution is adhered to a surface of the conductive fiber, in which the antibacterial material includes a metal oxide.

20 Claims, 2 Drawing Sheets

(51) Int. Cl.

| | |
|---|---|
| ***D06M 11/42*** | (2006.01) |
| ***D06M 11/44*** | (2006.01) |
| ***D06M 11/46*** | (2006.01) |
| ***D06M 11/49*** | (2006.01) |

(56) References Cited

U.S. PATENT DOCUMENTS

| | | | | |
|---|---|---|---|---|
| 6,267,782 | B1 | 7/2001 | Ogle et al. | |
| 2010/0086511 | A1* | 4/2010 | Sakamoto | D06M 16/00 424/76.1 |
| 2012/0088104 | A1* | 4/2012 | Hashimoto | D01D 5/247 428/401 |
| 2013/0149933 | A1* | 6/2013 | Varga | D01F 2/16 428/221 |
| 2016/0060793 | A1* | 3/2016 | Sugiura | D01D 4/022 423/447.2 |
| 2017/0314141 | A1* | 11/2017 | Xu | B82B 3/00 |
| 2020/0157709 | A1* | 5/2020 | Kanematsu | H10N 30/702 |

FOREIGN PATENT DOCUMENTS

| | | | | |
|---|---|---|---|---|
| CN | 101886285 | A | 11/2010 | |
| CN | 102926072 | A | 2/2013 | |
| CN | 105714352 | A | 6/2016 | |
| CN | 108193148 | A | 6/2018 | |
| CN | 108486860 | A | 9/2018 | |
| CN | 109295708 | A | 2/2019 | |
| EP | 2395580 | A1 | 12/2011 | |
| JP | H06338329 | A | 12/1994 | |
| JP | 2000064172 | A | 2/2000 | |
| JP | 2002542398 | A | 12/2002 | |
| JP | 2009-155732 | * | 7/2009 | D06M 11/45 |
| KR | 20160086209 | A | 7/2016 | |
| TW | 591155 | B | 6/2004 | |

OTHER PUBLICATIONS

Jiao, Yue, et al., "Carbon Fibers Encapsulated with Nano-Copper: A Core-Shell Structured Composite for Antibacterial and Electromagnetic Interference Shielding Applications". Nanomaterials, 2019, 9, 460, pp. 1-13.*

Chen, Jie, et al., "Antibacterial activity of graphene-modified anode on Shewanella oneidensis MR-1 biofilm in microbial fuel cell". Journal of Power Sources 290 (2015) 80-86.*

Varaprasad, Kokkarachedu, et al., "Nano zinc oxide-sodium alginate antibacterial cellulose fibres". Carbohydrate Polymers 135 (2016) 349-355.*

* cited by examiner

MANUFACTURING METHOD FOR ANTIBACTERIAL FIBER

CROSS-REFERENCE TO RELATED APPLICATION

This application claims priority to Taiwan Application Serial Number 110123905, filed Jun. 29, 2021, which is herein incorporated by reference.

BACKGROUND

Field of Disclosure

The present disclosure relates to a manufacturing method for an antibacterial fiber.

Description of Related Art

In recent years, with the improvement of living standards in today's society, people's demand for functional textiles is getting higher, and with the continuous advent of various functional textiles, the development of functional textiles with specific purposes also becomes more perfect.

In general, most textiles with antibacterial effect on the market are often directly made of fibers with an antibacterial property, and such fibers are usually doped or directly coated with antibacterial materials, such as metals or metal oxides, on a carrier, such as silica gel, ceramics, metal wire or mesh, activated carbon particles or powder, and graphene. However, the doping or coating process is often limited by the adhesion between the carrier and the antibacterial material. When the thickness of the antibacterial material formed is too thick, the antibacterial material is easy to peel off or fall off, which is not conducive to stably maintaining its antibacterial property. On the other hand, when the above-mentioned antibacterial material and carrier are used for the doping or coating process, the process steps are complicated and the materials are expensive, which is not conducive to mass production. Therefore, how to provide a manufacturing method for an antibacterial fiber, which can avoid excessively cumbersome process steps, and can make the antibacterial fiber produced have good antibacterial effect as well as stable structural strength, is an important issue for the industry in this field to actively study.

SUMMARY

According to some embodiments of the present disclosure, a manufacturing method for an antibacterial fiber includes the following steps. A dipping step is performed to soak a conductive fiber in a solution, in which the solution includes an ionic compound, and the ionic compound includes a metal cation. An oxidation step is performed by using the conductive fiber as an anode, such that an antibacterial material produced by the solution is adhered to a surface of the conductive fiber, in which the antibacterial material includes a metal oxide.

In some embodiments of the present disclosure, the solution includes 1 part by weight to 50 parts by weight of the ionic compound and 50 parts by weight to 99 parts by weight of a polar solvent.

In some embodiments of the present disclosure, the solution further includes 0.1 parts by weight to 10 parts by weight of a modifier, a surfactant, or a combination thereof, in which the modifier includes sodium citrate, polyvinylpyrrolidone, or a combination thereof.

In some embodiments of the present disclosure, the surfactant is a nonionic surfactant, a cationic surfactant, an anionic surfactant, or combinations thereof.

In some embodiments of the present disclosure, the antibacterial material includes an oxide of copper, silver, zinc, lead, cadmium, nickel, cobalt, iron, titanium, or combinations thereof.

In some embodiments of the present disclosure, in the oxidation step, the antibacterial material is adhered to the surface of the conductive fiber with a thickness between 0.10 μm and 1.00 μm.

In some embodiments of the present disclosure, the manufacturing method for the antibacterial fiber further includes the following step. A sintering step is performed, such that the antibacterial material is fixed on the surface of the conductive fiber, in which a sintering temperature of the sintering step is between 80° C. and 300° C.

In some embodiments of the present disclosure, the sintering step is carried out in an environment including inert gas, nitrogen, or a combination thereof.

In some embodiments of the present disclosure, the oxidation step is performed such that the surface of the conductive fiber has an oxygen-containing functional group.

In some embodiments of the present disclosure, the oxygen-containing functional group includes a hydroxyl group, a carbonyl group, a carboxyl group, or combinations thereof.

According to some other embodiments of the present disclosure, a manufacturing method for an antibacterial fiber includes the following steps. A dipping step is performed to soak a conductive fiber in a solution, in which the solution includes an ionic compound, and the ionic compound includes a metal cation. An oxidation step is performed by using the conductive fiber as an anode, such that an antibacterial material produced by the solution is adhered to a surface of the conductive fiber, in which the antibacterial material includes a metal oxide. An ultrasonic oscillation step is performed to remove an impurity on the surface of the conductive fiber. A sintering step is performed, such that the antibacterial material is fixed on the surface of the conductive fiber.

In some embodiments of the present disclosure, an oscillation frequency of the ultrasonic oscillation step is between 20 Hz and 50 Hz.

In some embodiments of the present disclosure, the solution includes 0.1 parts by weight to 10 parts by weight of a dopant, in which the dopant includes sodium citrate, polyvinylpyrrolidone, a nonionic surfactant, a cationic surfactant, an anionic surfactant, or combinations thereof.

In some embodiments of the present disclosure, the impurity includes the dopant.

In some embodiments of the present disclosure, the oxidation step is performed such that the surface of the conductive fiber has an oxygen-containing functional group.

In some embodiments of the present disclosure, the oxygen-containing functional group includes a hydroxyl group, a carbonyl group, a carboxyl group, or combinations thereof.

In some embodiments of the present disclosure, the sintering step is carried out in an environment including inert gas, nitrogen, or a combination thereof.

In some embodiments of the present disclosure, in the oxidation step, the antibacterial material is adhered to the surface of the conductive fiber with a thickness between 0.10 μm and 1.00 μm.

In some embodiments of the present disclosure, the antibacterial material includes an oxide of copper, silver, zinc, lead, cadmium, nickel, cobalt, iron, titanium, or combinations thereof.

In some embodiments of the present disclosure, the solution includes 1 part by weight to 50 parts by weight of the ionic compound and 50 parts by weight to 99 parts by weight of a polar solvent.

According to the aforementioned embodiments of the present disclosure, since during the manufacturing method for the antibacterial fiber of the present disclosure, the antibacterial material produced by the solution is disposed on the surface of the conductive fiber by means of oxidation, the antibacterial material and the conductive fiber can be tightly combined, thereby preventing the antibacterial material from peeling off or falling. As such, the antibacterial fiber can provide stable and good antibacterial effect. On the other hand, since the antibacterial material is produced from a solution which is less expensive, the cost is effectively solved.

BRIEF DESCRIPTION OF THE DRAWINGS

The disclosure can be more fully understood by reading the following detailed description of the embodiments, with reference made to the accompanying drawings as follows.

DETAILED DESCRIPTION

Reference will now be made in detail to the present embodiments of the disclosure, examples of which are illustrated in the accompanying drawings. However, it should be understood that these details should not be intend to limit the present disclosure. That is, in some embodiments of the present disclosure, these practical details are unnecessary, and therefore should not be used to limit the present disclosure.

Figure 1:
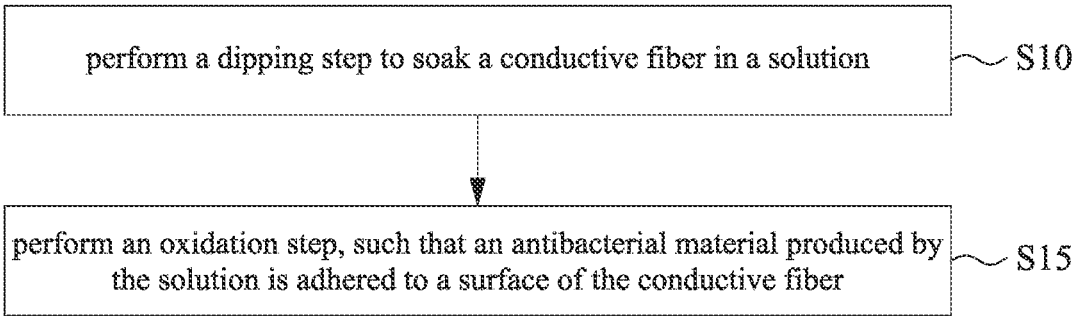
FIG. 1 is a flowchart illustrating a manufacturing method for an antibacterial fiber according to some embodiments of the present disclosure.

Reference is made to FIG. 1, in which FIG. 1 is a flowchart illustrating a manufacturing method for an antibacterial fiber according to some embodiments of the present disclosure. The manufacturing method for the antibacterial fiber of the present disclosure includes step S10 and step S15. In step S10, a dipping step is performed to soak the conductive fiber in a solution, in which the solution includes an ionic compound, and the ionic compound includes a metal cation. In step S15, an oxidation step is performed, such that an antibacterial material produced by the solution is adhered to a surface of the conductive fiber, in which the antibacterial material includes a metal oxide.

Firstly, in step S10, a dipping step is performed to soak the conductive fiber in a solution, in which the solution includes an ionic compound, and the ionic compound includes a metal cation. In some embodiments, the conductive fiber may be a carbon fiber, a silicon carbide fiber, an activated carbon fiber, or combinations thereof, so as to facilitate subsequent oxidation step. Since the above-mentioned conductive fiber has the advantages of good mechanical properties, such as high specific strength and specific modulus, high temperature resistance, chemical resistance, and electrical conductivity, as well as low friction coefficient, the subsequent formed antibacterial fiber can be provided with good toughness and durability. In some embodiments, the solution may include 1 part by weight to 50 parts by weight of the ionic compound and 50 parts by weight to 99 parts by weight of a polar solvent. The content ranges of the above-mentioned ionic compound and the polar solvent can ensure that the subsequently formed coating (for example, coatings including an antibacterial material) have suitable structural properties (for example, grain size and grain distribution uniformity, etc.), and that unnecessary side reactions can be avoided, and that the stability of the solution can be improved. In some embodiments, the cation (for example, metal cation) of the ionic compound can include a copper ion, a silver ion, a zinc ion, a lead ion, a cadmium ion, a nickel ion, a cobalt ion, an iron ion, a titanium ion, or combinations thereof. More specifically, the ionic compound may include silver nitrate, nickel nitrate, ferric chloride, titanium dioxide, copper sulfate, zinc sulfate, lead nitrate, cadmium chloride, cobalt nitrate, or combinations thereof. In some embodiments, the polar solvent may include water, alcohol (for example, ethanol), or a combination thereof, such that the ionic compound described above are preferably dissolved therein.

In some embodiments, the solution may further include 0.1 parts by weight to 10 parts by weight of a dopant. In detail, the dopant can include a modifier and a surfactant, in which the modifier can provide the subsequently formed antibacterial fiber with a better hand feeling (e.g., less grainy feeling), and the surfactant can ensure that the ionic compound is uniformly and stably dispersed in the polar solvent, thereby improving the uniformity of the coating adhered to the conductive fiber. Specifically, the modifier may include sodium citrate, polyvinylpyrrolidone, or a combination thereof. On the other hand, the surfactant can be a nonionic surfactant, a cationic surfactant, an anionic surfactant, or combinations thereof. Specifically, the nonionic surfactant may include alkyl polyoxyethylene ether, alkylphenol polyoxyethylene ether, aromatic hydrocarbon polyoxyethylene ether, styrene aromatic hydrocarbon polyoxyethylene ether, polyol polyoxyethylene ether, or combinations thereof; the cationic surfactant may include imidazoline ammonium salts, imidazolium salts, alkyl methyl ammonium salts, ester ammonium salts, amide salts, or combinations thereof; and the anionic surfactant may include phosphates, sulfates, sulfosuccinates, dodecyl sulfonates, or combinations thereof.

Next, in step S15, an oxidation step is performed on the solvent and the conductive fiber in the solvent, such that an antibacterial material produced by the solution is adhered to a surface of the conductive fiber, in which the antibacterial material includes a metal oxide. More specifically, during the oxidation step, a metal with low reactivity, such as carbon, titanium, platinum, etc., can be used as the cathode to connect to the negative electrode of the power source, and the conductive fiber can be used as the anode to connect to the positive electrode of the power source, and a voltage of about 0.2 volts to about 0.5 volts is applied to the solution to oxidize the metal cation of the ionic compound in the solution into the antibacterial material and deposit on the surface of the conductive fiber. In some embodiments, the antibacterial material may include, for example, an oxide of copper, silver, zinc, lead, cadmium, nickel, cobalt, iron, titanium, or combinations thereof. Since the above-mentioned antibacterial material us easy to form free radicals under the excitation of visible light, they can provide good antibacterial effects. In some embodiments, the antibacterial material can completely cover the surface of the conductive fiber, that is, the surface of the conductive fiber is not exposed (for example, exposed to the external environment), thereby enhancing the antibacterial effect.

Fibers such as carbon fibers, silicon carbide fibers, and activated carbon fibers are conductive and are a kind of conductive fibers. The conductive fiber is put into the above solution containing the ionic compound to perform the oxidation step, such that an oxygen-containing functional group is formed on the surface of the conductive fiber. The oxygen-containing functional group can promote the antibacterial material in the form of metal oxide to be firmly adhered to the surface of the conductive fiber. In some embodiments, the oxygen-containing functional group may, for example, include a hydroxyl group, a carbonyl group, a carboxyl group, or combinations thereof, thereby preferably reacting with metal cations. Compared with the conductive fibers without oxygen-containing functional groups, the conductive fiber with the oxygen-containing functional group after the oxidation step can further have a larger specific surface area, a more uniform pore size, and a more uniform pore size distribution, thereby better adsorbing the antibacterial material in the form of metal oxide. In some embodiments, the pre-treated conductive fiber may have a specific surface area ranging from 500 $m^2/g$ to 3000 $m^2/g$.

In some embodiments, the voltage applied during the oxidation step (i.e., the total quantity of electricity applied) can be adjusted accordingly according to the thickness of the antibacterial material to be formed. Specifically, the thickness of the antibacterial material to be formed can be controlled by the following formula (1) and formula (2). Formula (1): $W=(I\times t)/(Z\times F)$, in which W is the weight of the antibacterial material, I is the applied current, t is the oxidation time, Z is the valence of the metal cation, and F is the Faraday constant. Formula (2): $W=A\times t_h\times p$, in which W is the weight of the antibacterial material, A is the area of the antibacterial material, $t_h$ is the thickness of the antibacterial material, and p is the density of the antibacterial material. During the oxidation step, the antibacterial material may be adhered to the surface of the conductive fiber with a thickness between 0.10 μm and 1.00 μm, so as to provide antibacterial effect as well as structural strength. In detail, if the thickness of the antibacterial material is less than 0.10 μm, the antibacterial effect may be poor; if the thickness of the antibacterial material is greater than 1.00 μm, the antibacterial material may easily peel off, which is not conducive to the subsequent cutting of the antibacterial fiber. In some preferred embodiments, the thickness of the antibacterial material can be between 0.15 μm and 0.30 μm, so as to better achieve the above-mentioned effects. On the other hand, the dopant in the solution can also be deposited on the surface of the conductive fiber during the oxidation step, such that the subsequently formed antibacterial fiber can have a better hand feeling.

Figure 2:
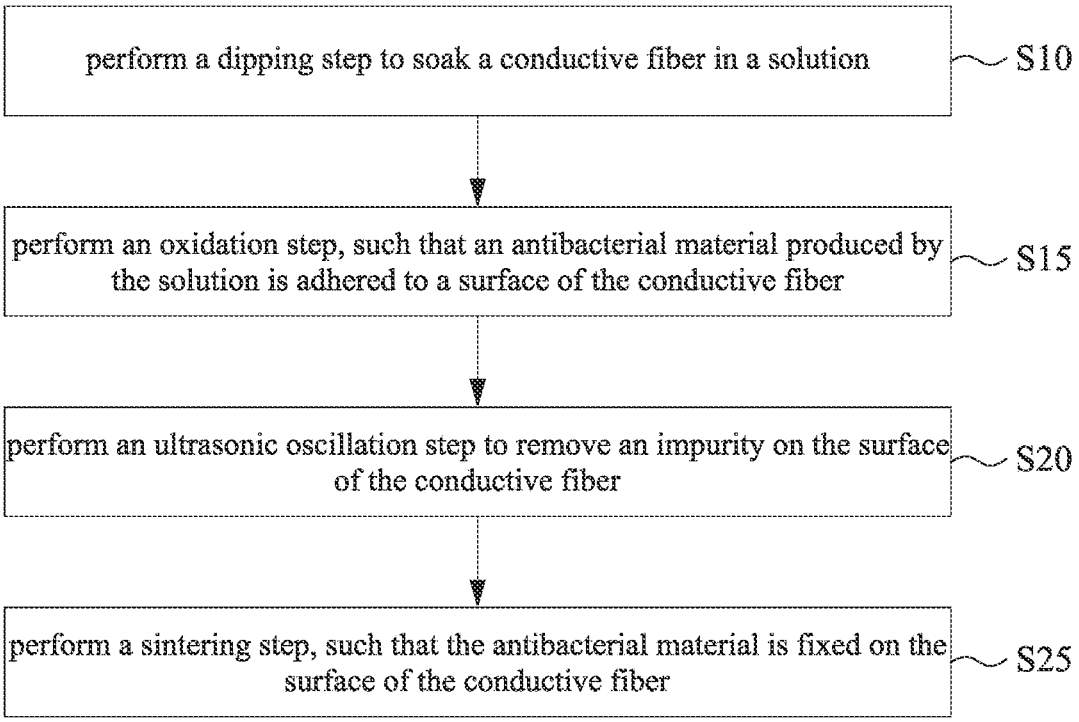
FIG. 2 is a flowchart illustrating a manufacturing method for an antibacterial fiber according to some other embodiments of the present disclosure.

Reference is made to FIG. 2, in which FIG. 2 is a flowchart illustrating a manufacturing method for an antibacterial fiber according to some other embodiments of the present disclosure. The manufacturing method for the antibacterial fiber of the present disclosure includes step S10 to step S25. In step S10, a dipping step is performed to soak the conductive fiber in a solution, in which the solution includes an ionic compound, and the ionic compound includes a metal cation. In step S15, an oxidation step is performed, such that an antibacterial material produced by the solution is adhered to a surface of the conductive fiber, in which the antibacterial material includes a metal oxide. In step S20, an ultrasonic oscillation step is performed to remove impurities on the surface of the conductive fiber. In step S25, a sintering step is performed, such that the antibacterial material is fixed on the surface of the conductive fiber. In the following description, the above-mentioned steps will be further described.

Firstly, in step S10 and step S15, a dipping step is performed to soak the conductive fiber in the solution, and an oxidation step is performed on the solution and the conductive fiber soaked in the solution, such that the antibacterial material produced by the solution is adhered to the surface of the conductive fiber. It should be understood that the step S10 and step S15 in FIG. 2 are respectively the same as the step S10 and step S15 in FIG. 1, which will not be repeated hereinafter.

Subsequently, in step S20, an ultrasonic oscillation step is performed to remove the impurities on the surface of the conductive fiber. In detail, after the oxidation step, the conductive fiber adhered with the antibacterial material can be taken out, and the surface of the conductive fiber can also be coated with other substances in the solution (for example, solutions, dopants, and/or the impurities generated during the oxidation step), and the ultrasonic oscillation step can remove the impurities on the surface of the conductive fiber, thereby preventing the impurities from affecting the antibacterial effect of the subsequently formed antibacterial fiber. In some embodiments, the ultrasonic oscillation step may further remove a portion of the dopant, while leaving only a portion of the dopant adhered to the surface of the conductive fiber. For example, a dopant such as sodium citrate and/or polyvinylpyrrolidone can be retained on the surface of the conductive fiber, such that the subsequently formed antibacterial fiber has a better hand feeling. In some embodiments, the oscillation frequency of the ultrasonic oscillation step can be between 20 Hz and 50 Hz, so as to remove the impurities well.

Next, in step S25, a sintering step is performed, such that the antibacterial material is fixed on the surface of the conductive fiber. Specifically, the ultrasonically oscillated conductive fiber (at least the conductive fiber coated with the antibacterial material) can be placed in a sintering furnace for the sintering step. In some embodiments, the sintering step is performed in an environment including inert gas, nitrogen, or a combination thereof, so as to improve the stability of the sintering step, avoid unnecessary side reactions, and prevent the further generation of impurities to damage the structural strength of the antibacterial material. In some embodiments, the sintering time of the sintering step may be between 1 minute and 60 minutes, and the sintering temperature may be between 80° C. and 300° C., so as to achieve close bonding between the antibacterial material and the conductive fiber, thereby making sure that the antibacterial material can be firmly attached (fixed) to the surface of the conductive fiber. In detail, if the sintering time is less than 1 minute and/or the sintering temperature is lower than 80° C., the sintering energy may be insufficient and the antibacterial material may fall off easily; if the sintering time is longer than 60 minutes and/or the sintering temperature is higher than 300° C., defects due to over burning may generate. In some embodiments, before the sintering step, a drying step may be performed on the ultrasonically oscillated conductive fiber to remove the solution attached on the surface of the conductive fiber. In some embodiments, the drying temperature of the drying step can be lower than the sintering temperature of the sintering step, so as to avoid the occurrence of structural defects due to excessive instantaneous temperature difference during the initial drying step of the conductive fiber after ultrasonic oscillation.

After the above steps, the antibacterial fiber of the present disclosure can be obtained, which at least include the conductive fiber and the antibacterial material fixed on the surface of the conductive fiber. The manufacturing method of the antibacterial fiber of the present disclosure can effectively avoid the antibacterial material from peeling off or falling off, such that the antibacterial material and the conductive fiber are closely combined, and hence the antibacterial fiber of the present disclosure has good structural strength and antibacterial properties.

The features and effects of the present disclosure will be described in more detail below with reference to the antibacterial fiber of each embodiment and the fiber of the comparative example. It should be understood that the materials used, their amounts and ratios, processing details and processing flow, etc. may be appropriately changed without departing from the scope of the present disclosure. Therefore, the present disclosure should not be limited by the embodiments described below. The detailed description of each embodiment and comparative example is shown in Table 1, and each embodiment is manufactured through the aforementioned steps.

TABLE 1

| | Conductive fiber | Solvent: Ionic compound | Solvent: Dopant | Solvent: Polar solvent | Voltage applied during oxidation step | Thickness of antibacterial material (μm) |
|---|---|---|---|---|---|---|
| Comparative Example 1 | Carbon fiber | N/A | N/A | N/A | N/A | N/A |
| Embodiment 1 | Carbon fiber | Silver nitrate (15 parts by weight) | Sodium citrate (5 parts by weight) | Water (80 parts by weight) | 0.80 V | 0.21 ± 0.01 |
| Embodiment 2 | Carbon fiber | Copper sulfate (20 parts by weight) | Sodium citrate (5 parts by weight) | Water (75 parts by weight) | 0.85 V | 0.28 ± 0.02 |
| Embodiment 3 | Carbon fiber | Nickel nitrate (25 parts by weight) | Sodium citrate (5 parts by weight) | Water (70 parts by weight) | 0.70 V | 0.16 ± 0.01 |

Experiment: Antibacterial Effect Test

In this experiment, the antibacterial effect test is carried out for each embodiment and comparative example, and the test method was to intercept about 30 centimeters to 50 centimeters of the (antibacterial) fiber and place it in a petri dish, then apply *Escherichia coli* (*E. coli*) to the surface of the (antibacterial) fiber, and then check the remaining number of *E. coli* after a month. Subsequently, the antibacterial property of the (antibacterial) fiber was calculated by the formula: [(the original number of *E. coli* before the test)−(the remaining number of *E. coli* after the test)/the original number of *E. coli* before the test]. The results are shown in Table 2.

TABLE 2

| | Antibacterial property (%) |
|---|---|
| Comparative Example 1 | 0.82 |
| Embodiment 1 | 80.50 |
| Embodiment 2 | 70.89 |
| Embodiment 3 | 73.15 |

As can be seen from the antibacterial results presented in Table 2, the antibacterial fiber made by the manufacturing method for the antibacterial fiber of the present disclosure still had a relatively high antibacterial property after a period of time. Therefore, it can be seen that the antibacterial material disposed on the surface of the conductive fiber had not been significantly peeled off or dropped over time, which showed that the antibacterial fiber of the present disclosure can maintain a certain degree of structural strength and achieve a good antibacterial effect.

According to the aforementioned embodiments of the present disclosure, since during the manufacturing method for the antibacterial fiber of the present disclosure, the antibacterial material produced by the solution is disposed on the surface of the conductive fiber by means of oxidation, the antibacterial material and the conductive fiber can be tightly combined, thereby preventing the antibacterial material from peeling off or falling. As such, the antibacterial fiber can provide stable and good antibacterial effect. On the other hand, since the antibacterial material is produced from a solution which is less expensive, the cost is effectively solved. In addition, based on the properties of the conductive fiber (e.g., large specific surface area) and the formation of the appropriate functional group on the surface of the conductive fiber, the conductive fiber can better adsorb the antibacterial material, which is more conducive to the fixation of the antibacterial material. In addition, by further controlling the thickness of the antibacterial material formed on the surface of the conductive fiber, the antibacterial material can be prevented from being peeled off or dropped due to its heavy weight, thereby improving the structural strength and durability of the antibacterial fiber.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure covers modifications and variations of this disclosure provided they fall within the scope of the following claims.

What is claimed is:

1. A manufacturing method for an antibacterial fiber, comprising:

performing a dipping step to soak a conductive fiber in a solution, wherein the solution comprises an ionic compound, and the ionic compound comprises a metal cation; and performing an oxidation step by using the conductive fiber as an anode, such that an antibacterial material produced by the solution is adhered to a surface of the conductive fiber, wherein the antibacterial material comprises a metal oxide.

2. The manufacturing method for an antibacterial fiber of claim 1, wherein the solution comprises:

1 part by weight to 50 parts by weight of the ionic compound; and 50 parts by weight to 99 parts by weight of a polar solvent.

3. The manufacturing method for an antibacterial fiber of claim 1, wherein the solution further comprises:

0.1 parts by weight to 10 parts by weight of a modifier, a surfactant, or a combination thereof, wherein the modifier comprises sodium citrate, polyvinylpyrrolidone, or a combination thereof.

4. The manufacturing method for an antibacterial fiber of claim 3, wherein the surfactant is a nonionic surfactant, a cationic surfactant, an anionic surfactant, or combinations thereof.

5. The manufacturing method for an antibacterial fiber of claim 1, wherein the antibacterial material comprises an oxide of copper, silver, zinc, lead, cadmium, nickel, cobalt, iron, titanium, or combinations thereof.

6. The manufacturing method for an antibacterial fiber of claim 1, wherein in the oxidation step, the antibacterial material is adhered to the surface of the conductive fiber with a thickness between 0.10 μm and 1.00 μm.

7. The manufacturing method for an antibacterial fiber of claim 1, further comprising:

performing a sintering step, such that the antibacterial material is fixed on the surface of the conductive fiber, wherein a sintering temperature of the sintering step is between 80° C. and 300° C.

8. The manufacturing method for an antibacterial fiber of claim 7, wherein the sintering step is carried out in an environment comprising inert gas, nitrogen, or a combination thereof.

9. The manufacturing method for an antibacterial fiber of claim 1, wherein the oxidation step is performed such that the surface of the conductive fiber has an oxygen-containing functional group.

10. The manufacturing method for an antibacterial fiber of claim 9, wherein the oxygen-containing functional group comprises a hydroxyl group, a carbonyl group, a carboxyl group, or combinations thereof.

11. A manufacturing method for an antibacterial fiber, comprising:

performing a dipping step to soak a conductive fiber in a solution, wherein the solution comprises an ionic compound, and the ionic compound comprises a metal cation;

performing an oxidation step by using the conductive fiber as an anode, such that an antibacterial material produced by the solution is adhered to a surface of the conductive fiber, wherein the antibacterial material comprises a metal oxide;

performing an ultrasonic oscillation step to remove an impurity on the surface of the conductive fiber; and performing a sintering step, such that the antibacterial material is fixed on the surface of the conductive fiber.

12. The manufacturing method for an antibacterial fiber of claim 11, an oscillation frequency of the ultrasonic oscillation step is between 20 Hz and 50 Hz.

13. The manufacturing method for an antibacterial fiber of claim 11, wherein the solution comprises:

0.1 parts by weight to 10 parts by weight of a dopant, wherein the dopant comprises sodium citrate, polyvinylpyrrolidone, a nonionic surfactant, a cationic surfactant, an anionic surfactant, or combinations thereof.

14. The manufacturing method for an antibacterial fiber of claim 13, wherein the impurity comprises the dopant.

15. The manufacturing method for an antibacterial fiber of claim 11, wherein the oxidation step is performed such that the surface of the conductive fiber has an oxygen-containing functional group.

16. The manufacturing method for an antibacterial fiber of claim 15, wherein the oxygen-containing functional group comprises a hydroxyl group, a carbonyl group, a carboxyl group, or combinations thereof.

17. The manufacturing method for an antibacterial fiber of claim 11, wherein the sintering step is carried out in an environment comprising inert gas, nitrogen, or a combination thereof.

18. The manufacturing method for an antibacterial fiber of claim 11, wherein in the oxidation step, the antibacterial material is adhered to the surface of the conductive fiber with a thickness between 0.10 μm and 1.00 μm.

19. The manufacturing method for an antibacterial fiber of claim 11, wherein the antibacterial material comprises an oxide of copper, silver, zinc, lead, cadmium, nickel, cobalt, iron, titanium, or combinations thereof.

20. The manufacturing method for an antibacterial fiber of claim 11, wherein the solution comprises:

1 part by weight to 50 parts by weight of the ionic compound; and 50 parts by weight to 99 parts by weight of a polar solvent.

* * * * *